US008190353B2

(12) United States Patent
White et al.

(10) Patent No.: US 8,190,353 B2
(45) Date of Patent: May 29, 2012

(54) AIRSPACE DESIGN EVALUATION

(75) Inventors: Michael J. White, Sterling, VA (US); Robert P. Bearer, Winchester, VA (US); Carla Ximena Gladstone, Bethesda, MD (US); James M. Reed, Arlington, VA (US); Steven R. Kalbaugh, Sr., Boca Raton, FL (US); Patrick L. Jones, Vienna, VA (US)

(73) Assignee: The MITRE Corporation, McLean, VA (US)

( * ) Notice: Subject to any disclaimer, the term of this patent is extended or adjusted under 35 U.S.C. 154(b) by 1493 days.

(21) Appl. No.: 11/510,781

(22) Filed: Aug. 28, 2006

(65) Prior Publication Data

US 2008/0062533 A1 Mar. 13, 2008

(51) Int. Cl.
*G06G 7/76* (2006.01)

(52) U.S. Cl. ..... 701/122; 701/120; 701/121; 340/961; 342/36; 342/37

(58) Field of Classification Search ..... 701/120, 701/121, 122; 340/951, 961; 342/29, 36, 342/37; 382/103
See application file for complete search history.

(56) References Cited

U.S. PATENT DOCUMENTS 4,839,658 A * 6/1989 Kathol et al. ..... 342/455
2006/0293840 A1* 12/2006 Klein ..... 701/201

OTHER PUBLICATIONS

A. Yousefi, G. Donohue, C. Chen, "Investigation of Airspace Metrics for Design and Evaluation of New ATM Concepts," presented at NEXTOR-FAA-INFORMS Conference, Falls Church, VA, 2003.*

E. Arri, "Air Traffic Control and Expected Aircraft Performance," ASRS Directline, March, pp. 5 and 10, 1991. [Online], Available: http://asrs.arc.nasa.gov/docs/dl/DL1.pdf. [Accessed Jan. 29, 2010].*

B. Davis "Airspace Analysis in the AT Airspace Laboratory," Transportation Resource Board 79th Annual Meeting Workshop, Washington D.C., 2000. [Online], Available: http://onlinepubs.trb.org/onlinepubs/circulars/ec035/16davis.pdf. [Accessed Jan. 29, 2010].*

A. Bayen, P. Grieder, C. Tomlin, "A Control Theoretic Predictive Model for Sector-Based Air Traffic Flow," AIAA GNC Conference, Monterey, CA, 2002.*

J. Histon and R. Hansman, "The Impact of Structure on Cognitive Complexity in Air Traffic Control," MIT International Center for Air Transportation, Jun. 2002.*

R. Mogford, J. Guttman, S. Morrow, and P. Kopardekar, "The Complexity Construct in Air Traffic Control: A Review and Synthesis of the Literature," U.S. Department of Transportation FAA, Atlantic City, NJ: FAA Technical Center, 1995.*

D. Bertsimas and S. Patterson, "The Air Traffic Flow Management Problem with Enroute Capacities," Operations Research, vol. 46, No. 3, Jun. 1998, pp. 406-422.*

* cited by examiner

*Primary Examiner* — Thomas Black
*Assistant Examiner* — Peter D Nolan
(74) *Attorney, Agent, or Firm* — Sterne, Kessler, Goldstein & Fox PLLC

(57) ABSTRACT

A computer based method, system and computer program product to assign a quality metric to an airspace design and optionally to compare it against design metrics, to determine a comparative quality metric. Factors contributing to quality of the airspace sector design are identified via user input and quantified to calculate a quality metric for the airspace sector design as a function of the quantified factors. Categories for each of the identified factors, and parameters for each of the identified categories are also identified via user input. Each parameter has an associated weight and a range of thresholds with associated multipliers. An associated multiplier from the range of thresholds for each identified parameter is also identified. The identified multiplier is multiplied with the associated weight for each identified parameter. The products for each identified parameter are then summed to obtain a quality metric.

35 Claims, 11 Drawing Sheets

400 404 406 408 410a 410b 410c 410d 410e 410f 410g 410h 410i 410j

402

Microsoft Excel - Sample SET Application.xls

File Edit View Insert Format Tools Data Window Help Type a question

A38 19

| | A | B | D | E | F | G | H | I | J | K | L | M | N | O |
|---|---|---|---|---|---|---|---|---|---|---|---|---|---|---|
| 1 | ID | Airspace Factor | Parameter | Parameter Weight | Values | 1 | 2 | 3 | 4 | 5 | 6 | 7 | 8 | 9 |
| 2 | 1 | Airspace Type: | Rate-IAC | 5 | Threshold | 4 | 9 | 10 | 11 | 12 | 13 | 14 | 15 | |
| 3 | | Ultra Low (SFC to 090) | | | Value | 2 | 1 | 0 | -1 | -2 | -3 | -4 | -5 | |
| 4 | 2 | Airspace Type: | Rate-15 Min | 5 | Threshold | 10 | 12 | 13 | 15 | 16 | 17 | 18 | 19 | |
| 5 | | Ultra Low (SFC to 090) | | | Value | 2 | 1 | 0 | -1 | -2 | -3 | -4 | -5 | |
| 6 | 3 | Airspace Type: | Rate-IAC | 4 | Threshold | 9 | 11 | 12 | 13 | 14 | 15 | 16 | 17 | |
| 7 | | Low (100 to FL230 or SFC to FL230) | | | Value | 2 | 1 | 0 | -1 | -2 | -3 | -4 | -5 | |
| 8 | 4 | Airspace Type: | Rate-15 Min | 4 | Threshold | 10 | 13 | 16 | 17 | 19 | 20 | 21 | 22 | 23 |
| 9 | | Low (100 to FL230 or SFC to FL230) | | | Value | 3 | 2 | 1 | 0 | -1 | -2 | -3 | -4 | -5 |
| 10 | 5 | Airspace Type: | Rate-IAC | 4 | Threshold | 11 | 13 | 15 | 16 | 18 | 19 | 20 | 21 | 22 |
| 11 | | High (FL240 to FL340 or FL240 and Above) | | | Value | 3 | 2 | 1 | 0 | -1 | -2 | -3 | -4 | -5 |
| 12 | 6 | Airspace Type: | Rate-15 Min | 4 | Threshold | 13 | 16 | 19 | 20 | 22 | 24 | 25 | 26 | 27 |
| 13 | | High (FL240 to FL340 or FL240 and Above) | | | Value | 3 | 2 | 1 | 0 | -1 | -2 | -3 | -4 | -5 |
| 14 | 7 | Airspace Type: | Rate-IAC | 4 | Threshold | 11 | 14 | 17 | 18 | 20 | 22 | 23 | 24 | 25 |
| 15 | | Ultra High (FL350 and Above) | | | Value | 3 | 2 | 1 | 0 | -1 | -2 | -3 | -4 | -5 |
| 16 | 8 | Airspace Type: | Rate-15 Min | 4 | Threshold | 15 | 18 | 21 | 22 | 24 | 25 | 26 | 27 | 28 |
| 17 | | Ultra High (FL350 and Above) | | | Value | 3 | 2 | 1 | 0 | -1 | -2 | -3 | -4 | -5 |
| 18 | 9 | Airspace Type: | Rate-IAC | 4 | Threshold | 11 | 14 | 17 | 18 | 20 | 22 | 23 | 24 | 25 |
| 19 | | Other (SFC & Above) | | | Value | 3 | 2 | 1 | 0 | -1 | -2 | -3 | -4 | -5 |
| 20 | 10 | Airspace Type: | Rate-15 Min | 4 | Threshold | 15 | 18 | 21 | 22 | 24 | 25 | 26 | 27 | 28 |
| 21 | | Other (SFC & Above) | | | Value | 3 | 2 | 1 | 0 | -1 | -2 | -3 | -4 | -5 |
| 22 | 11 | Commonality: | % | 5 | Threshold | 15 | 30 | 45 | 60 | 80 | 90 | 100 | | |
| 23 | | Ultra Low (SFC to 090) | | | Value | -5 | -4 | -3 | -2 | -1 | 0 | 1 | | |
| 24 | 12 | Commonality: | % | 4 | Threshold | 15 | 30 | 45 | 60 | 80 | 90 | 100 | | |
| 25 | | Low (100 to FL230 or SFC to FL230) | | | Value | -5 | -4 | -3 | -2 | -1 | 0 | 1 | | |
| 26 | 13 | Commonality: | % | 3 | Threshold | 15 | 30 | 45 | 60 | 80 | 90 | 100 | | |
| 27 | | High & Ultra-Hi (FL240 and Above) | | | Value | -5 | -4 | -3 | -2 | -1 | 0 | 1 | | |

FIG. 4A

AIRSPACE DESIGN EVALUATION

GOVERNMENT LICENSE RIGHTS

The U.S. government has a paid-up license in this invention and the right in limited circumstances to require the patent owner to license others on reasonable terms as provided for by the terms of 02044206-PW, awarded by The Federal Aviation Administration (FAA).

FIELD OF THE INVENTION

The present invention relates generally to airspace design and more specifically to evaluation of airspace design quality.

BACKGROUND ART

Airspace design activities typically begin as a response to a problem in an existing airspace design. Over time, traffic grows and patterns diverge from those intended by the airspace designers. Sectors may become congested or constrained, causing excess air traffic controller workload and requiring frequent flow control actions. In extreme cases, controllers may even have to deny handoffs on occasion. To correct these problems, airspace designers typically modify principal aircraft flows, sector shapes and sizes, or sector floors and ceilings. Airspace designers may also split or combine sectors.

The airspace design process often begins with a simple drawing of the major traffic flows and a proposed sector shape. Designers then evaluate the proposed design. However, the overall evaluation is subjective, based solely on the designer's knowledge and judgment. There is a lack of objective guidelines, design rules and tools to evaluate the quality of an airspace design.

What is needed is a method and system for evaluating an airspace design.

BRIEF SUMMARY OF THE INVENTION

The invention comprises a computer based method incorporating an expert knowledge base to evaluate the quality of an airspace sector design including identifying factors contributing to quality of the airspace sector design, quantifying the factors and calculating a quality metric for the airspace sector design as a function of the quantified factors. The method also comprises identifying categories for each of the identified factors and identifying parameters for each of the identified categories. Each parameter has an associated weight and a range of associated threshold values. The method further includes determining a threshold from the range of threshold values and a multiplier associated with the identified threshold value for each identified parameter. Lastly, the method includes calculating a product of the associated weight and the determined multiplier for each identified parameter, and calculating a sum of the products for each identified parameter to obtain a quality metric.

The invention also comprises a system to refine, design and evaluate an airspace sector design including a design characteristics database of quantified factors contributing to quality of an airspace sector design and a computational unit coupled to the design characteristics database. The computational unit is enabled to receive user input identifying factors contributing to a quality of the airspace sector design and calculate a quality metric for the airspace sector design based on the identified factors. The computational unit is enabled to receive user input to generate an airspace sector design using a drawing database and a geographical database that are coupled to the computational unit.

The invention further comprises a computer program product including a computer useable medium with control logic stored therein for designing and evaluating an airspace sector design. The computer program product includes control logic means for receiving user input to create an airspace sector design and for receiving user input identifying factors contributing to quality of the airspace sector design. The computer program product also includes control logic means for calculating a quality metric for the airspace sector design based on the quantified factors.

Additional features and advantages of the invention will be set forth in the description which follows, and in part will be apparent from the description, or may be learned by practice of the invention.

It is to be understood that both the foregoing general description and the following detailed description are exemplary and explanatory and are intended to provide further explanation of the invention as claimed. The detailed description is not intended to limit the scope of the claimed invention in any way.

BRIEF DESCRIPTION OF THE FIGURES

The accompanying drawings, which are included to provide a further understanding of the invention and are incorporated in and constitute a part of this specification, illustrate embodiments of the invention and together with the description serve to explain the principles of the invention. In the drawings:

FIG. 4A illustrates an example spreadsheet to evaluate an airspace design according to an embodiment of the invention.

Figure 1:
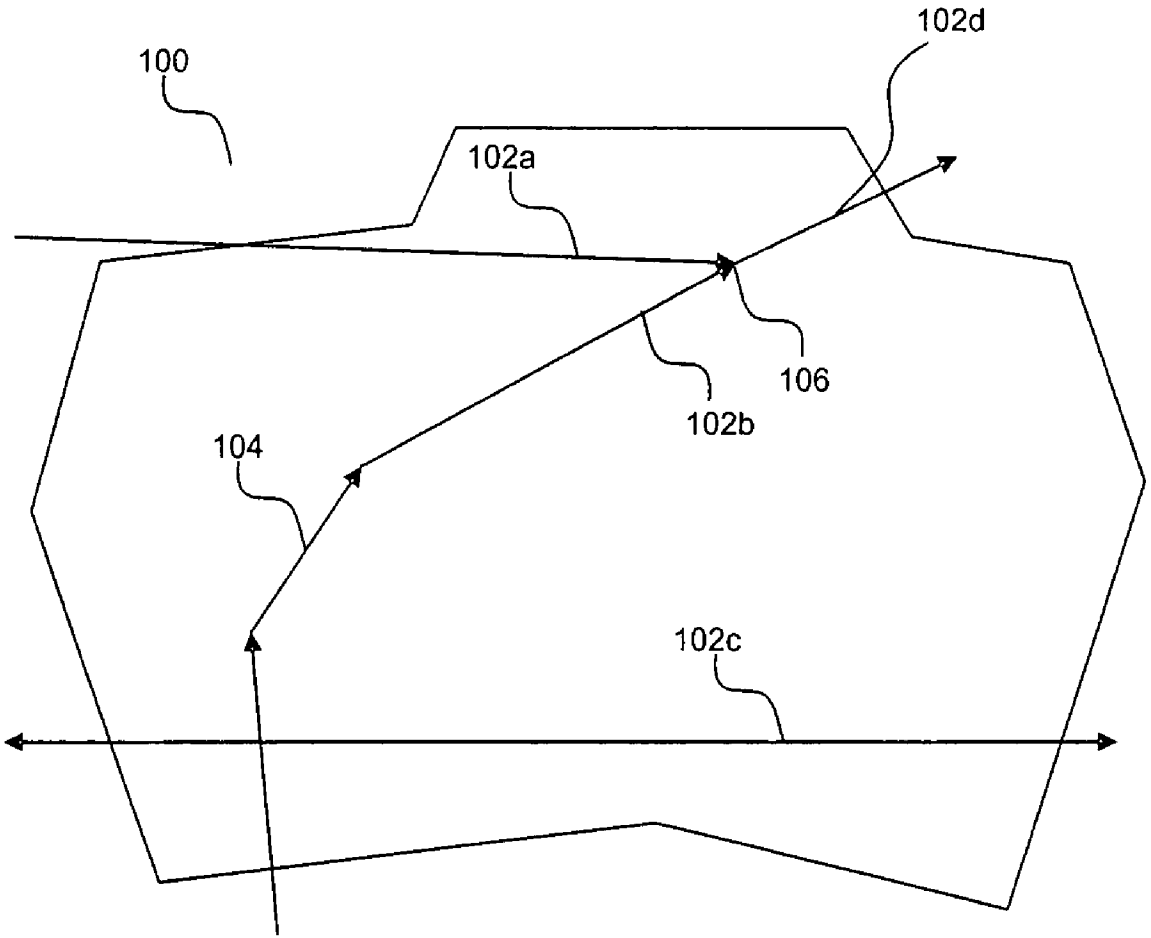
FIG. 1 illustrates an example airspace sector design.

The present invention will now be described with reference to the accompanying drawings. In the drawings, like reference numbers may indicate identical or functionally similar elements. Additionally, the left-most digit(s) of a reference number may identify the drawing in which the reference number first appears.

DETAILED DESCRIPTION OF THE INVENTION

The present invention provides computer based tools and methods to evaluate the quality of an airspace sector design. A method of the present invention includes identifying factors contributing to the quality of the airspace sector design, quantifying the factors and calculating a quality metric for the airspace sector design as a function of the quantified factors.

The method includes identifying categories for each of the identified factors and identifying parameters for each of the identified categories. Each parameter has an associated weight and a range of associated threshold values. The method further includes determining an associated multiplier from the range of associated threshold values for each identified parameter, calculating a product of the associated weight and the determined multiplier for each identified parameter, and calculating a sum of the products for each identified parameter to obtain a quality metric for an airspace sector design. In an example, all quantitative values used in airspace sector quality evaluation are obtained by leveraging the knowledge of experienced airspace designers. The quantitative values may be stored in a database.

This specification discloses one or more embodiments that incorporate the features of this invention. The embodiment(s) described, and references in the specification to "an example", "one embodiment", "an embodiment", "an example embodiment", etc., indicate that the embodiment(s) or example(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Example Environment

An airspace design can be divided into sectors. FIG. 1 illustrates an example airspace sector 100. The airspace sector 100 may comprise, for example, uni-directional flows 102*a*, 102*b*, 102*d* or bi-directional flows 102*c*, dogleg 104 and merge point 106. Flows 102, may be. A merge occurs when two or more flows (as in flows 102*a*, 102*b*) of traffic converge at a single point (as in merge point 106) and become one flow as in uni-directional flow 102*d*. Sector 100, flows 102*a*-102*d*, dog leg 104 and merge point 106 are shown as way of example and do not limit the invention in any way.

Example Embodiments

In embodiments of the invention, for airspace designs, specific "factors" that describe quality of the airspace design are identified and quantified. Examples of factors include airspace type, flow factors etc. Specific characteristics of a particular factor are referred to as "categories". Examples of categories include low altitude sectors, high altitude sectors etc. For each category one or more "parameters" are identified. Examples of parameters include instantaneous aircraft count, 15 minute aircraft count etc. Each parameter may have an associated "weight" that is identified and quantified along with a range of associated "thresholds". "Multipliers" associated with thresholds are also provided. The weight associated with each parameter defines its importance in relation to other parameters. In an example, weights may be on a scale of 1 to 5, with 5 being the most important and 1 being the least important compared to other parameters. Similarly, in an example, the multipliers associated with the threshold values may be on a scale of −5 to +5. A score of zero may indicate a nominal level of quality in that parameter. Positive values indicate quality better than a nominal level of quality and negative values indicate quality worse than a nominal level of quality.

Figure 2:
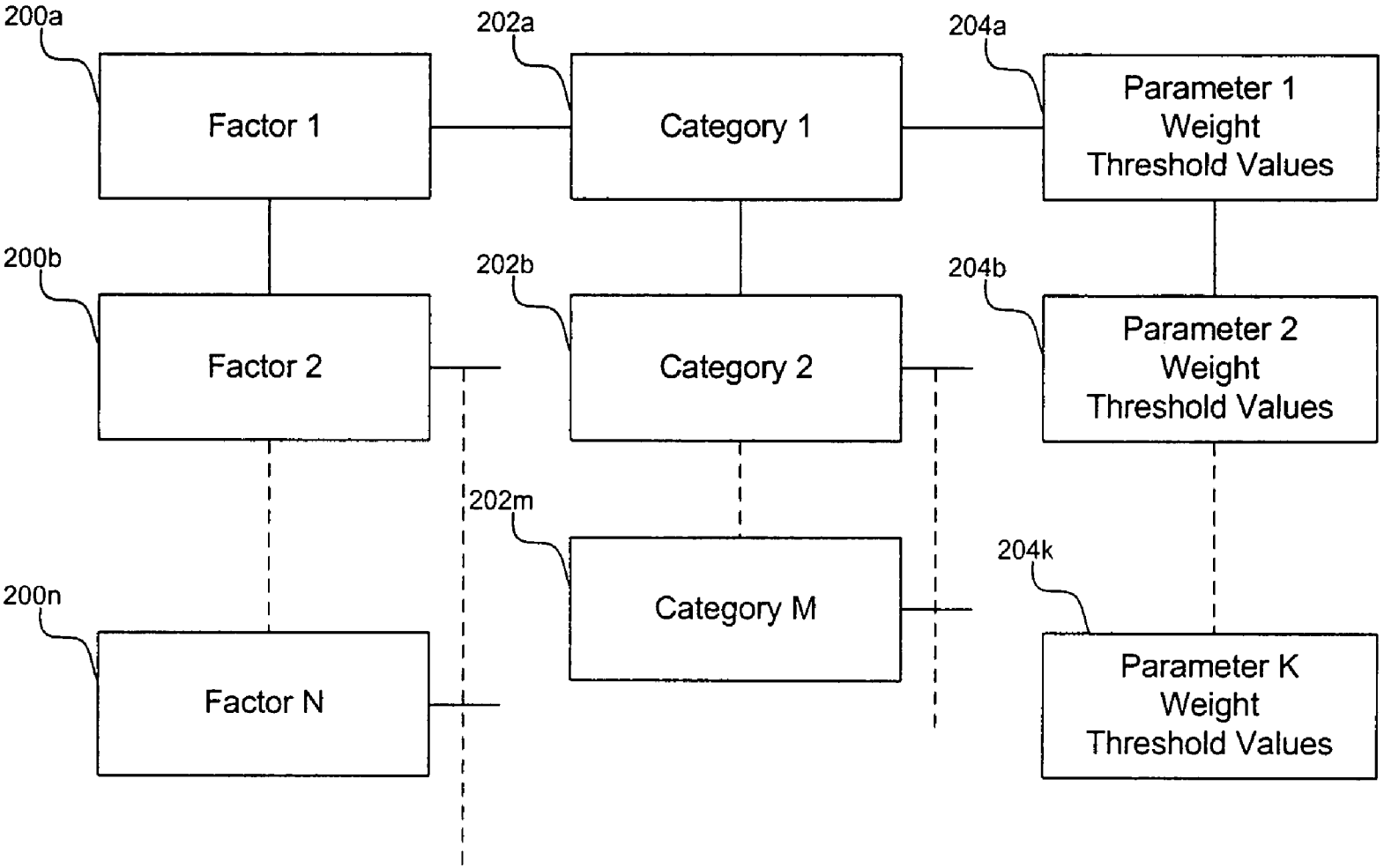
FIG. 2 illustrates an example relationship between factors, categories and parameters.

FIG. 2 illustrates an example relationship between factors 200*a*, 200*b* . . . 200*n*, categories 202*a*, 202*b* . . . 202*m* and parameters 204*a*, 204*b* . . . 204*k*. Each factor may have one or more categories and each category may have one or more parameters. Each parameter has an associated weight and threshold value. For example, factor 200*a* has categories 202*a* to 202*m* and category 202*a* has parameters 204*a* to 204*k*. Each factor may have a different number of categories and each category may have a different number of parameters. Further examples of airspace factors, categories and parameters are described below.

Figure 3A:
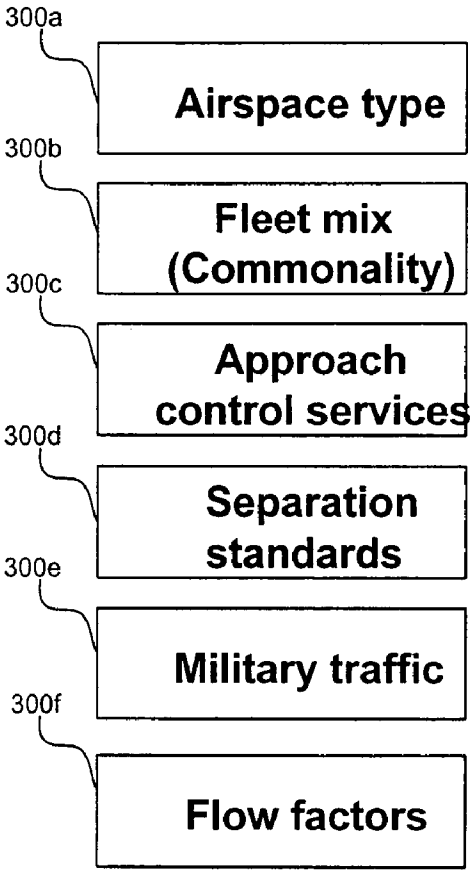
FIG. 3A illustrates examples of factors.

FIG. 3A illustrates example factors 300. An airspace type factor 300*a* represents various airspace types. If a sector comprises more than one airspace type then a predominant airspace type may be used. If a sector extends beyond the altitudes specified under airspace types then the category that most closely represents the airspace being evaluated may be used. Airspace types are broken down into five altitude categories (not shown). Ultra low is airspace from the surface to 9999 feet. Low is airspace from 10,000 feet to flight level 239. High is airspace from flight level 240 to flight level 339 and ultra high is airspace from flight level 340 and above. Another airspace category may be airspace from the surface and above. Two parameters (not shown) are identified for each of the five categories. The first parameter is the number of aircraft in the sector at any given moment, i.e., Instantaneous Aircraft Count (IAC), entered as the peak count at any given time for the day. The second parameter is the total number of aircraft for a fifteen minute period, entered as the peak period of the day. The IAC is the peak count at any given time for the day. The fifteen minute period is the peak period for the day. Traffic files used to determine parameter values reflect a day of normal operations when traffic volume is high for the facility and represents one of the facility's top thirty-seven days.

A fleet mix commonality factor 300*b* summarizes the impact of fleet mix on airspace design quality, where air traffic control "fleet mix" is a measure of the relative percentages of different types of aircraft for a particular sector. Powered aircraft are included and are divided into three categories (not shown) of props (e.g., piston engine aircrafts and helicopters), turbo-props, and turbojets. The percentage of each aircraft type that makes up the sector traffic is the parameter associated with each category. Commonality is described in greater detail below.

An approach control services factor 300*c* captures the complexity involved when a sector provides approach control services. It also captures the quality of a sector providing different levels of airport advisory services. The associated parameter(s) for each category of approach control services factor 300*c* describes the number of airports in the sector for which these services are provided.

A separation standards factor 300*d* relates to separation standards other than the basic 5 nautical miles (NM) en route surveillance standard. Separation standards factor 300*d* includes the category "horizontal" (not shown) which has parameters (not shown) that are classified as a 3 NM parameter and a 3 NM to 5 NM parameter to trigger the calculation of reduced surveillance minima. Separation standards factor 300*d* also has categories "non-radar" and "transitional" (not shown). There are no thresholds required for the parameters associated with the "non-radar" and "transitional" categories; however, non-radar and transitional categories have a threshold value of 1 to apply the associated parameter multiplier to calculations.

A military traffic factor 300*e* includes categories (not shown) for different military air traffic operations, such as air re-fueling tracks and Airborne Warning and Control System (AWACS) Orbits that have quantified parameters (not shown). Each military air traffic operation has an associated factor parameter which measures how many of these operations occur within a sector, e.g. the number of air re-fueling tracks and the number of AWACS Orbits within a sector.

The flow factors factor 300*f* and its associated categories and parameters are discussed in further detail below with regards to FIGS. 3B and 3C.

Figure 3B:
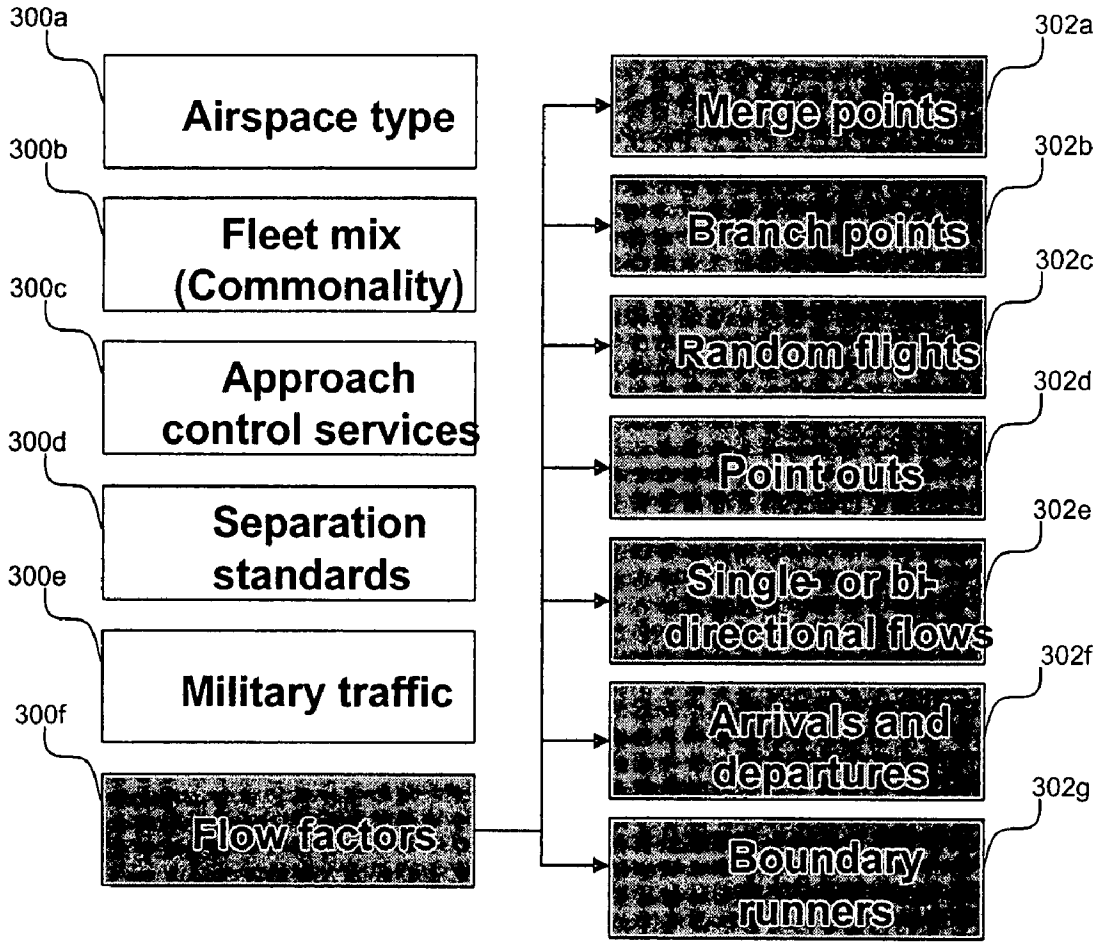
FIG. 3B illustrates examples of factors and categories.

FIG. 3B illustrates example categories 302*a*-302*g* of flow factors factor 300*f*. Flow factors factor 300*f* includes example categories such as merge points 302*a*, branch points 302*b*, random flights 302*c*, point outs 302*d*, single or bi-directional flows 302*e*, arrivals and departures 302*f* and boundary runners 302*g*.

The category of merge points 302*a* relates to merge points as in merge point 106. Merge points 302*a* are calculated for each merge within a sector. The category of merge points 302*a* and its associated parameters are discussed in more detail below with regard to FIG. 3C.

The category of branch points 302*b* represents points at which a single flow diverges into two or more flows and are calculated for each branch within a sector. The parameters for branch points are weighted less than those for merge points 302*a* since separation must be established between flows inbound to the merge point, whereas when a single flow branches from the branch point into two or more flows, separation is required to be maintained only as the flow diverges. Only the number of branches and the number of branches from one flow may be used as parameters of a branch point. Crossing traffic is defined as a combination of a merge and a branch and becomes the sum of the calculated values of merge points and branch points.

The category of random flights 302*c* relates to flights that do not remain within a limited lateral and vertical section of airspace, and hence do not create a flow of traffic or a pattern. These categories include parameters of: (1) the number of flows impacted by these flights, and (2) whether the impacted flows are climbing or descending.

The category of point outs 302*d* provides a value for point-outs that are required due to the creation of an airspace shelf. This category and its parameters (not shown) are calculated for each shelf within a sector. Whenever a flight enters a sector, it must be handed-off to the air traffic controller who is responsible for that sector. If a flight crosses a sector boundary and enters an adjacent airspace sector for even a brief period of time, it must still be transferred to the adjacent sector controller. These transfers of control are referred to as "point outs." The point out parameter measures the number of point-outs per hour, per shelf.

The category of single or bi-directional flows 302*e* relates to structured or unstructured flows that are procedural and are governed by a Letter of Agreement (LOA), Standard Terminal Arrival Route (STAR), Departure Procedure (DP) or airway definitions. Unstructured flows are user-preferred trajectories that remain within a limited lateral and vertical portion of airspace to create a common flow of traffic. The flow parameters measure several metrics which include but are not limited to distances between adjacent flows, flow fleet mix commonality, number of flows merging, number of flows crossing, and the traffic flow rate. Several other parameters (not shown) may also be defined for flows.

The category of arrivals and departures 302*f* addresses arrival and departure restrictions required by a LOA between facilities or standard operating procedures within facilities. Arrivals and departures 302*f* includes parameter arrival compression (not shown) as an aircraft descends and compression created when an aircraft is required to reduce to 250 knots above 10,000 feet. These categories are evaluated for each arrival flow. Arrivals and departures 302*f* also includes parameter departure spacing (not shown) that often increases as speeds increase above 10,000 feet, with threshold values set by altitude.

The category of boundary runners 302*g* addresses the distance of a traffic flow from adjacent boundaries or boundary runners. A "boundary runner" refers to an air traffic flow that is located proximate to a sector boundary. Flights that travel within a specific distance from a boundary, such as 5 nautical miles, are typically transferred or "pointed-out" to the adjacent sector controller. Airspace designers typically try to avoid designing sectors with boundary runners because such designs may require additional air traffic control. The boundary runner parameter measures the number of flows which are located within a specific distance from a sector boundary. Such flows are likely to be boundary runners.

Figure 3C:
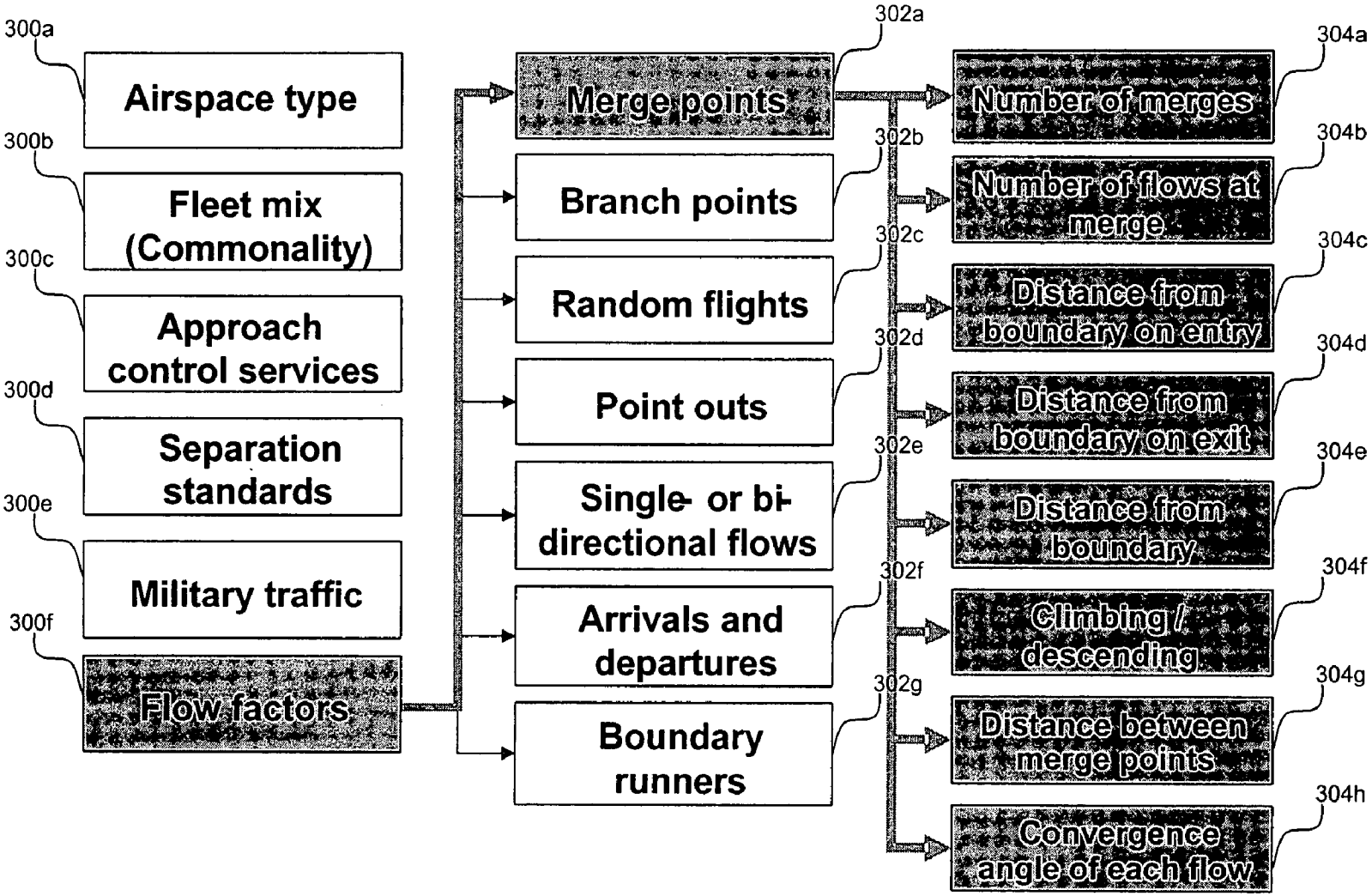
FIG. 3C illustrates examples of factors, categories and parameters.

FIG. 3C illustrates example parameters 304*a*-304*h* of the category merge points 302*a* of flow factors factor 300*f*. Merge points 302*a* includes parameters such as: number of merges 304*a*, number of flows at a merge 304*b*, distance from boundary on entry 304*c*, distance from boundary on exit 304*d*, distance from boundary 304*e*, climbing or descending 304*f*, distance between merge points 304*g* and convergence angle of each flow 304*h*.

Every parameter of a merge point may not apply for every merge point in a sector. Where the merge of a flow begins in one sector and ends in another sector, only those factors of the merge point are measured that impact the sector being studied to correctly measure airspace quality. Parameters 304*a* and 304*b* are described below.

The parameter of number of merges 304*a*, measures the number of merge points in a sector.

The parameter of number of flows at merge 304*b* measures each flow of a merge against each of the other flows within that merge and repeats for every individual merge in a sector.

Flights in a particular sector flow enter a sector at a specific entry point, and exit at an exit point. The flights in the flow may merge or cross at merge points or crossing points, respectively. The parameter distance from boundary on entry 304*c* refers to the distance from the sector entry point to the merge point.

The parameter distance from boundary on exit 304*d* refers to the distance from a particular merge point to the exit point.

The parameters number of flights counting/descending 304*f* counts the number of flights climbing (gaining altitude), and the number of flights descending (losing altitude).

The parameter distance between merge points 304*g*, measures the distances between each pair of merge points in nautical miles.

The parameter convergence angle of a flow 304*h* measures the angle between each pair of merging flows.

In one embodiment, the overall quality score for an airspace design is the weighted sum of selected parameter weights and parameter multipliers. The parameter multipliers are selected as a function of associated parameter threshold values. This overall score is called the "Airspace Quality Metric" (AQM) and is the sum of the products of all relevant parameter weights and parameter multipliers. An airspace design can be evaluated by identifying the individual factors, categories and parameters that apply to the airspace sector design in question, selecting pre-assigned weights and multipliers for each parameter and then computing the AQM.

FIG. 4A illustrates an example spreadsheet used to evaluate an airspace design according to an embodiment of the invention. In this embodiment, a Sector Evaluation Tool (SET) database was implemented in a SET Spreadsheet Tool (SST) 400. SST 400 includes a column for factor identification 402, factors and categories 404, parameters 406 with corresponding parameter weights 408, threshold values/multipliers 410. In this example, SST 400 is implemented using Microsoft Excel. In one embodiment, the SST 400 may interface with a database such as a Microsoft Access database or an Oracle database. In this example factors and categories are shown together in the column labeled Airspace Factor 404. In column 404, categories for each factor are listed below the factor and a description of the category is provided in parentheses. SST 400 allows users to select factors and categories simultaneously for inclusion in the analysis. In another example, SST 400 may have factors and categories in separate columns and may require the user to select factors and categories separately. SST 400 may also allow users (such as program developers and air traffic control experts) to assign threshold values to parameters. SST 400 automatically computes the AQM for an airspace design after the factors, categories, parameter weights and threshold values/multipliers have been identified by a user.

For example, consider a sector evaluated for the factor Airspace Type, under the category of high altitude and for the parameter Rate-IAC. The data for this factor/category/parameter can be found in the row corresponding to factor ID 5. If the threshold value for parameter Rate-IAC for that sector is 15, then a multiplier of 1 in the column 410*d* corresponding to the threshold value of 15 is identified. The weight corresponding to the factor Airspace Type, under the category of high altitude and for the parameter Rate-IAC is identified to be 4 under the column parameter weight 408. The parameter multiplier multiplied by the parameter weight gives a partial quality score. In this case, the value is +4 obtained by the product of the parameter multiplier 1 and the parameter weight 4. All partial quality scores for each identified factor/category/parameter are summed by SST 400 to obtain an AQM for an airspace design.

Table 1 below provides another example of a spreadsheet that includes example factors, categories and parameters. Table 1 includes 58 rows that comprise 8 factors and their associated categories, parameters, parameter weights, thresholds and multipliers.

TABLE 1

| ID | Airspace Factor | Category | Parameter | Parameter Weight | Values | 1 | 2 | 3 | 4 |
|---|---|---|---|---|---|---|---|---|---|
| 1. | Airspace Type | Ultra Low (SFC to 090) | Rate-IAC | 5 | Threshold | 4 | 9 | 10 | 11 |
| | | | | | Multiplier | 2 | 1 | 0 | −1 |
| 2. | Airspace Type | Ultra Low (SFC to 090) | Rate-15 Min | 5 | Threshold | 10 | 12 | 13 | 15 |
| | | | | | Multiplier | 2 | 1 | 0 | −1 |
| 3. | Airspace Type | Low (100 to FL230 or SFC to FL230) | Rate-IAC | 4 | Threshold | 9 | 11 | 12 | 13 |
| | | | | | Multiplier | 2 | 1 | 0 | −1 |
| 4. | Airspace Type | Low(100 to FL230 or SFC to FL230) | Rate-15 Min | 4 | Threshold | 10 | 13 | 16 | 17 |
| | | | | | Multiplier | 3 | 2 | 1 | 0 |
| 5. | Airspace Type | High (FL240 to FL330 or FL240 and Above) | Rate-IAC | 4 | Threshold | 11 | 13 | 15 | 16 |
| | | | | | Multiplier | 3 | 2 | 1 | 0 |
| 6. | Airspace Type | High (FL240 to FL330 or FL240 and Above) | Rate-15 Min | 4 | Threshold | 13 | 16 | 19 | 20 |
| | | | | | Multiplier | 3 | 2 | 1 | 0 |
| 7. | Airspace Type | Ultra High (FL340 and Above) | Rate-IAC | 4 | Threshold | 11 | 14 | 17 | 18 |
| | | | | | Multiplier | 3 | 2 | 1 | 0 |
| 8. | Airspace Type | Ultra High (FL340 and Above) | Rate-15 Min | 4 | Threshold | 15 | 18 | 21 | 22 |
| | | | | | Multiplier | 3 | 2 | 1 | 0 |
| 9. | Airspace Type | Other (SFC & Above) | Rate-IAC | 4 | Threshold | 11 | 14 | 17 | 18 |
| | | | | | Multiplier | 3 | 2 | 1 | 0 |
| 10. | Airspace Type | Other (SFC & Above) | Rate-15 Min | 4 | Threshold | 15 | 18 | 21 | 22 |
| | | | | | Multiplier | 3 | 2 | 1 | 0 |
| 11. | Airspace Shelves | Shelves That Require Point Outs | Point Outs per day | 4 | Threshold | 10 | 20 | 30 | 50 |
| | | | | | Multiplier | −1 | −2 | −3 | −4 |
| 12. | SUAs | Impacted Flows | Number of flows impacted by active SUAs | 2 | Threshold | 1 | 2 | 3 | |
| | | | | | Multiplier | −1 | −3 | −5 | |
| 13. | ARTCC provides Approach Services | VFR Tower on Airport Provides Services | Number of Airports | 3 | Threshold | 1 | 2 | 3 | |
| | | | | | Multiplier | −2 | −3 | −4 | |
| 14. | ARTCC provides Approach Services | FSS/Provides AAS at Airport | Number of Airports | 3 | Threshold | 1 | 2 | 3 | |
| | | | | | Multiplier | −1 | −2 | −3 | |
| 15. | ARTCC provides Approach Services | No Services at Airport | Number of Airports | 3 | Threshold | 1 | 2 | 3 | |
| | | | | | Multiplier | −1 | −2 | −3 | |
| 16. | Separation Standards | Horizontal | 3 NM | 5 | Threshold | 3 | | | |
| | | | | | Multiplier | 3 | | | |
| 17. | Separation Standards | Horizontal | Transitional, 3 NM to 5 NM | 3 | Threshold | 3 | | | |
| | | | | | Multiplier | 2 | | | |
| 18. | Separation Standards | Non-Radar | | 5 | Threshold | 1 | | | |
| | | | | | Multiplier | −5 | | | |
| 19. | Separation Standards | Transitional | Radar to Non-radar | 4 | Threshold | 1 | | | |
| | | | | | Multiplier | −3 | | | |
| 20. | Flow Factors | LOA TRACON Arrival Fix Restrictions | Number of Arrival fixes | 4 | Threshold | 1 | 2 | 3 | 4 |
| | | | | | Multiplier | 0 | −2 | −4 | −5 |
| 21. | Flow Factors | LOA/SOP Enroute Altitude Restrictions | Number of Restrictions | 3 | Threshold | 1 | 2 | 3 | 4 |
| | | | | | Multiplier | −1 | −2 | −3 | −4 |

TABLE 1-continued

| ID Airspace Factor | Category | Parameter | Parameter Weight | Values | 1 | 2 | 3 | 4 |
|---|---|---|---|---|---|---|---|---|
| 22. Flow Factors | Flow Type | Arrival Compression By Altitude (flight level) | 4 | Threshold<br>Multiplier | 10<br>0<br>−3 | 230<br>−2 | 60<br>0<br>0 | |
| 23. Flow Factors | Flow Type | Arrival Speed Restrictions 250K above 10,000 | 4 | Threshold<br>Multiplier | 1<br>−3 | | | |
| 24. Flow Factors | Flow Type | Departure By Altitudes (flight level) | 2 | Threshold<br>Multiplier | 10<br>0<br>0 | 230<br>2 | 60<br>0<br>1 | |
| 25. Flow Factors | Structured Flows | Uni-Directional | 3 | Threshold<br>Multiplier | 1<br>3 | | | |
| 26. Flow Factors | Structured Flows | Bi-Directional regardless of altitude | 4 | Threshold<br>Multiplier | 1<br>−2 | | | |
| 27. Flow Factors | Unstructured Flows | Uni-Directional | 3 | Threshold<br>Multiplier | 1<br>2 | | | |
| 28. Flow Factors | Unstructured Flows | Bi-Directional | 4 | Threshold<br>Multiplier | 1<br>−4 | | | |
| 29. Flow Factors | Random Flights | Number of Flows Impacted | 2 | Threshold<br>Multiplier | 1 | 2 | 3 | 4 |
| 30. Flow Factors | Random Flights | Flows Impacted that are Climbing and/or Descending | 4 | Threshold<br>Multiplier | 1<br>−1 | 2<br>−2 | 3<br>−3 | 4<br>−4 |
| 31. Flow Factors | Boundary Runners | Distance of flow from boundaries | 2 | Threshold<br>Multiplier | 3<br>−5 | 5<br>−2 | 7<br>−1 | 8<br>0 |
| 32. Flow Factors | Turn Point (Dogleg) | Degrees of Turn | 3 | Threshold<br>Multiplier | 10<br>0 | 20<br>−1 | 30<br>−2 | 40<br>−3 |
| 33. Flow Factors | Merge Points | Distance fro Sector Boundary On Exit | 4 | Threshold<br>Multiplier | 5<br>5 | 10<br>4 | 15<br>3 | 20<br>2 |
| 34. Flow Factors | Merge Points | Distance from Sector Boundary On Entry | 4 | Threshold<br>Multiplier | 20<br>−5 | 25<br>−4 | 30<br>−3 | 40<br>−2 |
| 35. Flow Factors | Merge Points | Number of Merges in Sector | 4 | Threshold<br>Multiplier | 0<br>0 | 1<br>−1 | 2<br>−3 | 3<br>−5 |
| 36. Flow Factors | Merge Points | Number of Flows Merging into One | 4 | Threshold<br>Multiplier | 0<br>0 | 2<br>−1 | 3<br>−3 | 4<br>−5 |
| 37. Flow Factors | Merge Points | Distance Between Merge Points | 4 | Threshold<br>Multiplier | 10<br>−5 | 15<br>−4 | 20<br>−3 | 25<br>−2 |
| 38. Flow Factors | Merge Points | Convergence Angle of Each Flow | 4 | Threshold<br>Multiplier | 15<br>0 | 30<br>−1 | 40<br>−2 | 50<br>−3 |
| 39. Flow Factors | Merge Points | Altitude Range | 2 | Threshold<br>Multiplier | 90<br>0 | 230<br>−2 | 33<br>0<br>−1 | 34<br>0<br>0 |
| 40. Flow Factors | Merge Points | Aircraft TAS Speed in Knots | 2 | Threshold<br>Multiplier | 20<br>0<br>0 | 300<br>−1 | 42<br>5<br>−2 | 42<br>6<br>−3 |
| 41. Flow Factors | Merge Points | Climbing | 4 | Threshold<br>Multiplier | 1<br>−2 | | | |
| 42. Flow Factors | Merge Points | Descending | 4 | Threshold<br>Multiplier | 1<br>−2 | | | |
| 43. Flow Factors | Merge Points | Climbing or Descending into En-route Stream | 3 | Threshold<br>Multiplier | 1<br>−1 | | | |
| 44. Flow Factors | Branch Points | Number of Branches in Sector | 1 | Threshold<br>Multiplier | 1<br>0 | 2<br>−3 | 3<br>−5 | |

TABLE 1-continued

| ID | Airspace Factor | Category | Parameter | Parameter Weight | Values | 1 | 2 | 3 | 4 |
|---|---|---|---|---|---|---|---|---|---|
| 45. | Flow Factors | Branch Points | Number of Flows Branching from One Flow | 2 | Threshold | 2 | 3 | 4 | 5 |
| | | | | | Multiplier | 0 | −2 | −3 | −5 |
| 46. | Commonality Ultra Low (SFC to 090) | Props, Turbo-Props & Jets | % | 5 | Threshold | 15 | 30 | 45 | 60 |
| | | | | | Multiplier | −5 | −4 | −3 | −2 |
| 47. | Commonality Low (100 to FL230 or SFC to FL230) | Props, Turbo-Props & Jets | % | 4 | Threshold | 15 | 30 | 45 | 60 |
| | | | | | Multiplier | −5 | −4 | −3 | −2 |
| 48. | Commonality, High & Ultra-HI (FL240 and Above) | Turbo-Props & Jets | % | 3 | Threshold | 15 | 30 | 45 | 60 |
| | | | | | Multiplier | −5 | −4 | −3 | −2 |
| 49. | Commonality (SFC & Above) | Props, Turbo-Props & Jets | % | 4 | Threshold | 15 | 30 | 45 | 60 |
| | | | | | Multiplier | −5 | −4 | −3 | −2 |
| 50. | Other Characteristics | Freq Requirements | Multiple RCAG/Same Freq | 2 | Threshold | 1 | | | |
| | | | | | Multiplier | −1 | | | |
| 51. | Other Characteristics | Freq Requirements | Multiple Freqs | 2 | Threshold | 1 | | | |
| | | | | | Multiplier | −2 | | | |
| 52. | Other Characteristics | International Flights Coming into USA | Limited TFM | 2 | Threshold | 1 | | | |
| | | | | | Multiplier | −3 | | | |
| 53. | Other Characteristics | International Flights | Language Constraints | 1 | Threshold | 1 | | | |
| | | | | | Multiplier | −2 | | | |
| 54. | Other Characteristics | Military Traffic | Air Refueling Tracks/Stationary | 5 | Threshold | 1 | | | |
| | | | | | Multiplier | −5 | | | |
| 55. | Other Characteristics | Military Traffic | Air Refueling Tracks/Moving | 3 | Threshold | 1 | | | |
| | | | | | Multiplier | −1 | | | |
| 56. | Other Characteristics | Military Traffic | AWACS Orbits | 3 | Threshold | 1 | | | |
| | | | | | Multiplier | −1 | | | |
| 57. | Other Characteristics | Military Traffic | ALTRV/Stationary | 2 | Threshold | 1 | | | |
| | | | | | Multiplier | −1 | | | |
| 58. | Other Characteristics | Military Traffic | ALTRV/Moving | 3 | Threshold | 1 | | | |
| | | | | | Multiplier | −2 | | | |

A key factor in sector performance is the commonality of the planned traffic in the sector. Commonality is the degree to which the traffic is homogeneous with respect to aircraft type and performance. Traffic flows that carry a wide mix of aircraft types with different performance characteristics are generally more difficult to handle than flows comprising aircraft with more similar characteristics.

Table 2 below provides examples that may be used to determine the fleet mix commonality for the fleetmix factor 300*b*. The percentage of each aircraft type that makes up the sector traffic file is the parameter multiplier associated with each category. The commonality number may be entered as multipliers in a spreadsheet as in SST 400 or as in Table 1.

TABLE 2

Factor: Ultra Low, Low Airspace and Surface and Up Airspace Commonality
Category: Props, Turbo-props, Jets
Parameter: %

| # | % | % | % | Commonality | Comments |
|---|---|---|---|---|---|
| 1 | 98 | 1 | 1 | 97 | Best case |
| 2 | 90 | 5 | 5 | 85 | Any three types |
| 3 | 90 | 10 | 0 | 80 | Any two types |
| 4 | 80 | 10 | 10 | 70 | Any three types |
| 5 | 80 | 20 | 0 | 60 | Any two types |
| 6 | 70 | 20 | 10 | 55 | Any three types |
| 7 | 70 | 30 | 0 | 40 | Any two types |
| 8 | 60 | 20 | 20 | 40 | Any three types |
| 9 | 60 | 40 | 0 | 20 | Any two types |
| 10 | 40 | 30 | 30 | 10 | Any three types |
| 11 | 50 | 50 | 0 | 0 | Worst case any two types |
| 12 | 33 | 33 | 33 | 0 | Worst case three types |

TABLE 2-continued

Factor: High Airspace Commonality.
Category: Turbo-props, Jets
Parameter: %

| # | % | % | Commonality | Comments |
|---|---|---|---|---|
| 1 | 100 | 0 | 100 | Best Case |
| 2 | 90 | 10 | 80 | |
| 3 | 80 | 20 | 60 | |
| 4 | 70 | 30 | 40 | |
| 5 | 60 | 40 | 20 | |
| 6 | 50 | 50 | 0 | Worse Case |

SST 400 may include the information presented in table 2 to assess the degree of commonality. A commonality score is extracted from this table based on the input mix of one, two or three types of aircraft in a stream and the approximate relative proportions of each. The commonality table is in two parts: ultra low, low and surface-to-infinity in the first part and high altitude in the second part. Ultra high sectors have only jet aircraft, so commonality is not an issue and is not evaluated for high sectors.

In an example, a low altitude sector with three types of traffic in approximately equal numbers would receive a commonality score of zero as a worst case. The same sector with only two types of traffic in a 90%/10% proportion would receive a commonality score of 80, reflecting a higher degree of commonality.

Figure 4B:
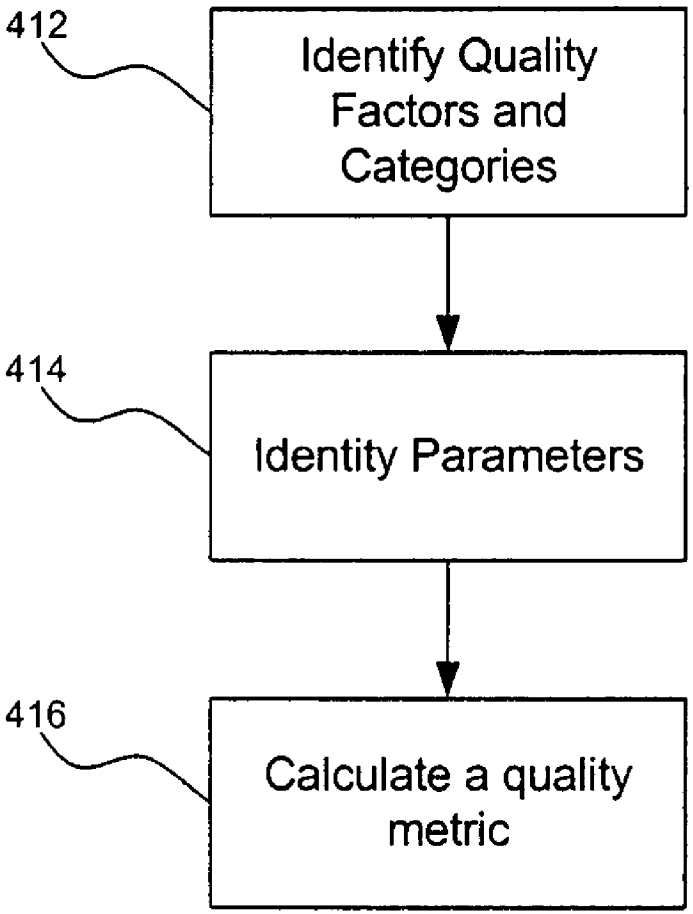
FIG. 4B illustrates an exemplary flowchart to evaluate an airspace design according to an embodiment of the invention.

FIG. 4B illustrates an exemplary flowchart showing steps to evaluate an airspace design. These steps may be performed by SST 400 according to an embodiment of the invention. These steps may be performed for each airspace sector design or for the entire airspace design over multiple sectors at once.

In step 412, factor and categories under the column airspace factors 404 are identified for an airspace design. The factors and categories may be identified by user input via a GUI generated by SST 400.

In step 414, one or more parameters 406 are identified for each factor and category identified in step 412. The parameters may be identified by user input via a GUI generated by SST 400.

In step 416, a quality metric such as an AQM is calculated for the airspace sector design in question based on data obtained in steps 412 and 414. The AQM may be calculated based on parameter weights 408 and multipliers 410. An example method of calculating the quality metric is described below with reference to the flowchart in FIG. 6.

Alternate Embodiments

In one embodiment, an automated Computer Aided Design (CAD) tool is used to create and evaluate airspace designs. The CAD software will support drawing traffic flows and sector shapes, and will evaluate them based on a database of airspace design characteristics. These characteristics comprise a working definition of optimal airspace design characteristics developed by analysts such as airspace designers and operational controllers. The CAD tool is referred to as SETCAT (Sector Evaluation Tool Computer Aided Design Tool) throughout the application. SETCAT greatly enhances the utility of the SET database by adding Geographical Information System (GIS) capabilities with evaluation of the airspace using a database of airspace design characteristics. GIS systems provide a blend of both traditional CAD drawing and geographical database features that are ideally suited to drawing and analyzing airspace designs. Two- and three-dimensional drawing tools are used to create geographically accurate maps of airspace designs. The GIS database may comprise a drawing database, a geographical database and a design characteristics database. GIS database tools may be used to store information about airspace design characteristics. The GIS database may also contain a version of the SET database which may be used with geospatial analysis tools to calculate AQM values for each sector design or for the entire airspace design over multiple sectors.

SETCAT enables analysts to draw airspace designs to scale, and to calculate AQM for the designs. SETCAT also explores the relationships between sector geometry, traffic flows and other sector characteristics. SETCAT supports airspace design creation, modification, and evaluation. It provides a human computer interface to specify airspace design characteristics. The human computer interface may be a GUI. It supports both two-dimensional and three-dimensional views of airspace designs. It accepts user identified factors, categories, parameters, weights and thresholds contributing to the quality of an airspace design. It typically calculates an AQM or similar quality metric for the airspace design under consideration based on the user identified values. The SETCAT tool also facilitates comparisons between different airspace designs by comparing the airspace design under consideration and its quality metric to design metrics stored in the design characteristics database and calculating a comparative quality metric. The design metrics may be other standard airspace designs and/or quality metrics.

Figure 5A:
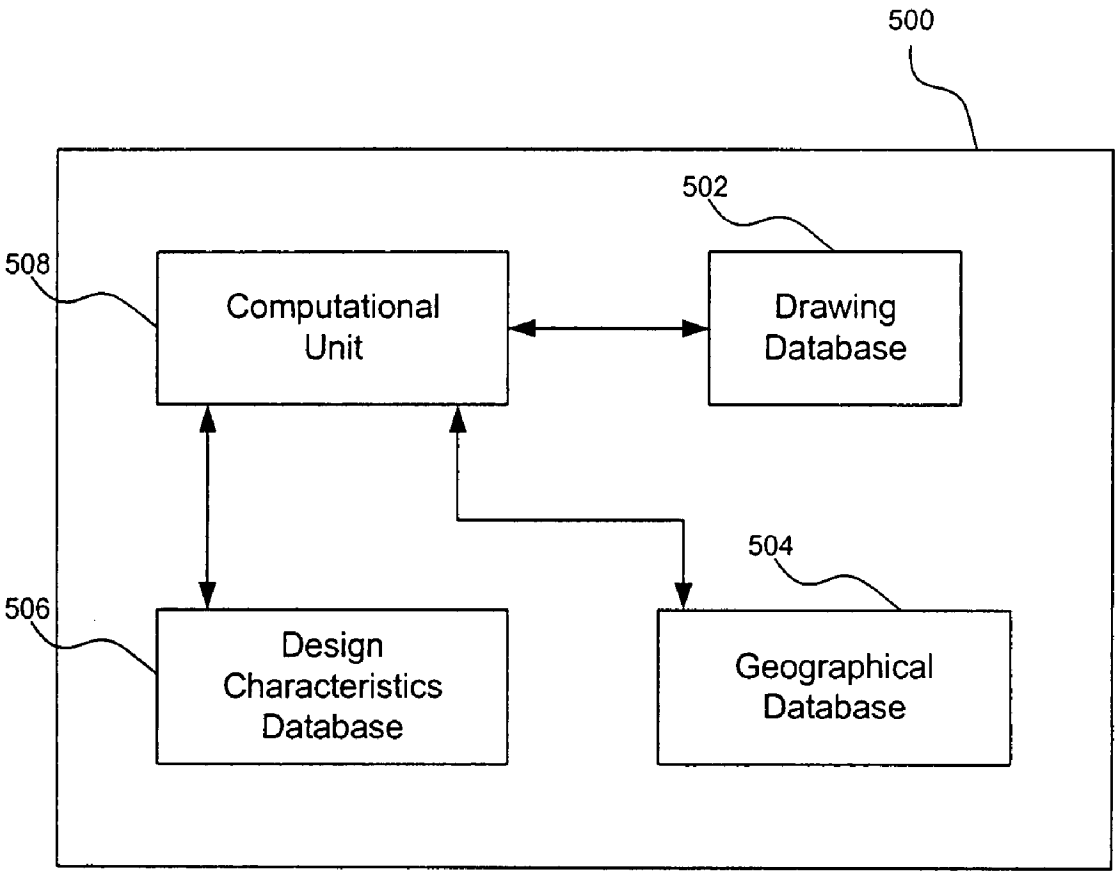
FIG. 5A illustrates an example system to design and evaluate an airspace design according to an embodiment of the invention.

FIG. 5A illustrates an example SETCAT system 500 to design and evaluate an airspace design according to an embodiment of the invention. The system includes a computational unit 508 coupled to a drawing database 502, a geographical database 504 and a design characteristics database 506. Computational unit 508 generates a GUI to allow for user input. Using geographical database 504 and drawing database 502, computational unit 508 creates and displays geographically accurate two- and three-dimensional maps of airspace designs in response to user input. In one embodiment, computational unit 508 may be a processor. SETCAT explores the relationships between sector geometry, traffic flows and other sector characteristics, based on user identified factors, and calculates a quality metric for each airspace sector design using design characteristics database 506. In one embodiment, SETCAT is enabled to compare an airspace sector design quality metric against other quality design metrics to determine a comparative quality metric.

Figure 5B:
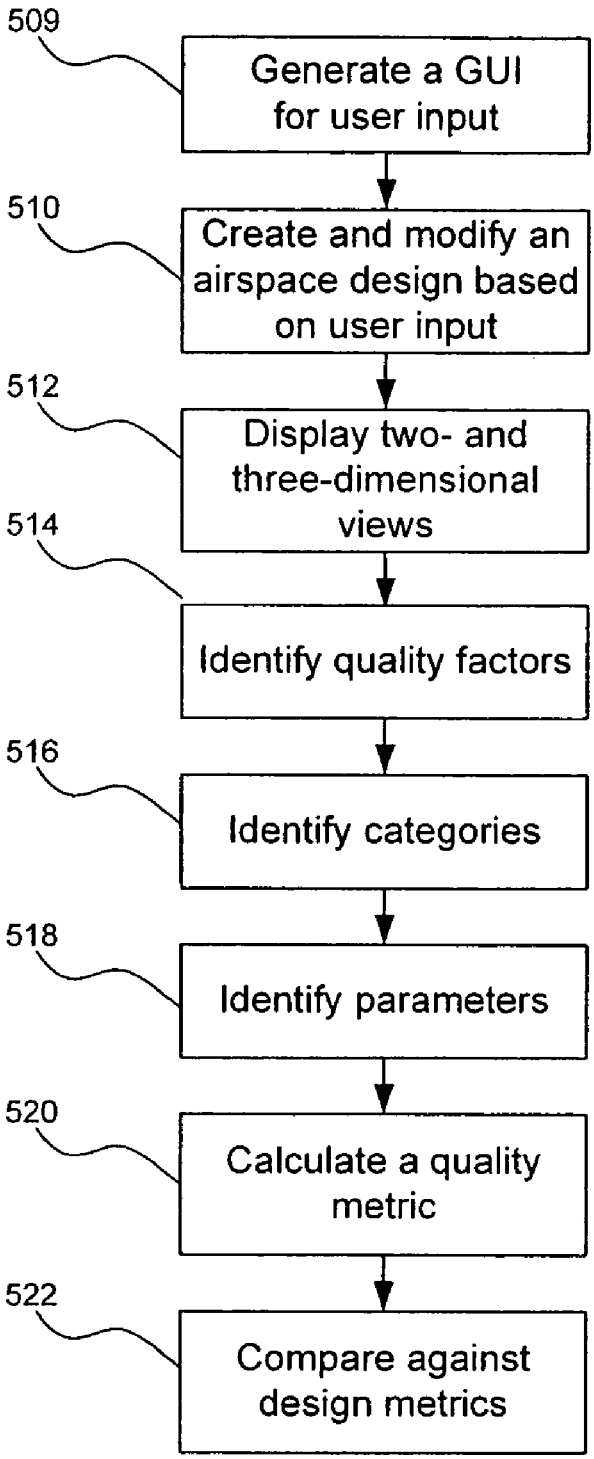
FIG. 5B is an exemplary flowchart showing steps to design and evaluate an airspace design according to an alternate embodiment of the invention.

FIG. 5B is an exemplary flowchart showing steps to design and evaluate an airspace sector design according to an embodiment of the invention. In one embodiment these steps may be performed using the structure provided for the SETCAT system 500 in FIG. 5A.

In step 509, a GUI is generated to allow for user input. In one embodiment, the GUI may be generated by computational unit 508 and displayed on a monitor.

In step 510, an airspace sector design is created and/or modified by user input via the GUI generated in step 509. In one embodiment, computational unit 508 may use geographical database 504 and drawing database 502 to create and modify the airspace design according to user input.

In step 512, a two- and/or three-dimensional view of the airspace generated in step 510 is displayed via a GUI on a monitor. The GUI may be the same as in step 509. The GUI may be generated using computational unit 508.

In step 514, one or more quality factors for the airspace sector design created or modified in step 510 are identified. The factors are typically identified by user input.

In step 516, one or more categories are identified for each of the factors identified in step 514. The categories are typically identified via user input.

In step 518, one or more parameters are identified for each of the categories identified in step 516. The parameters are typically identified via user input.

In step 520, a quality metric for the airspace sector design is calculated. The quality metric may be calculated by computational unit 508 using data from design characteristics database 506. The quality metric may be a function of the factors, categories and parameters identified in steps 514, 516 and 518 respectively. An example method of calculating a quality metric is described below with reference to the flowchart in FIG. 6.

In step 522, the design created or modified in step 510 and the quality metric calculated in step 520 are compared against design metrics to determine a comparative quality of the design. In one embodiment, the comparison is made by computational unit 508 using data from design characteristics database 506.

Figure 6:
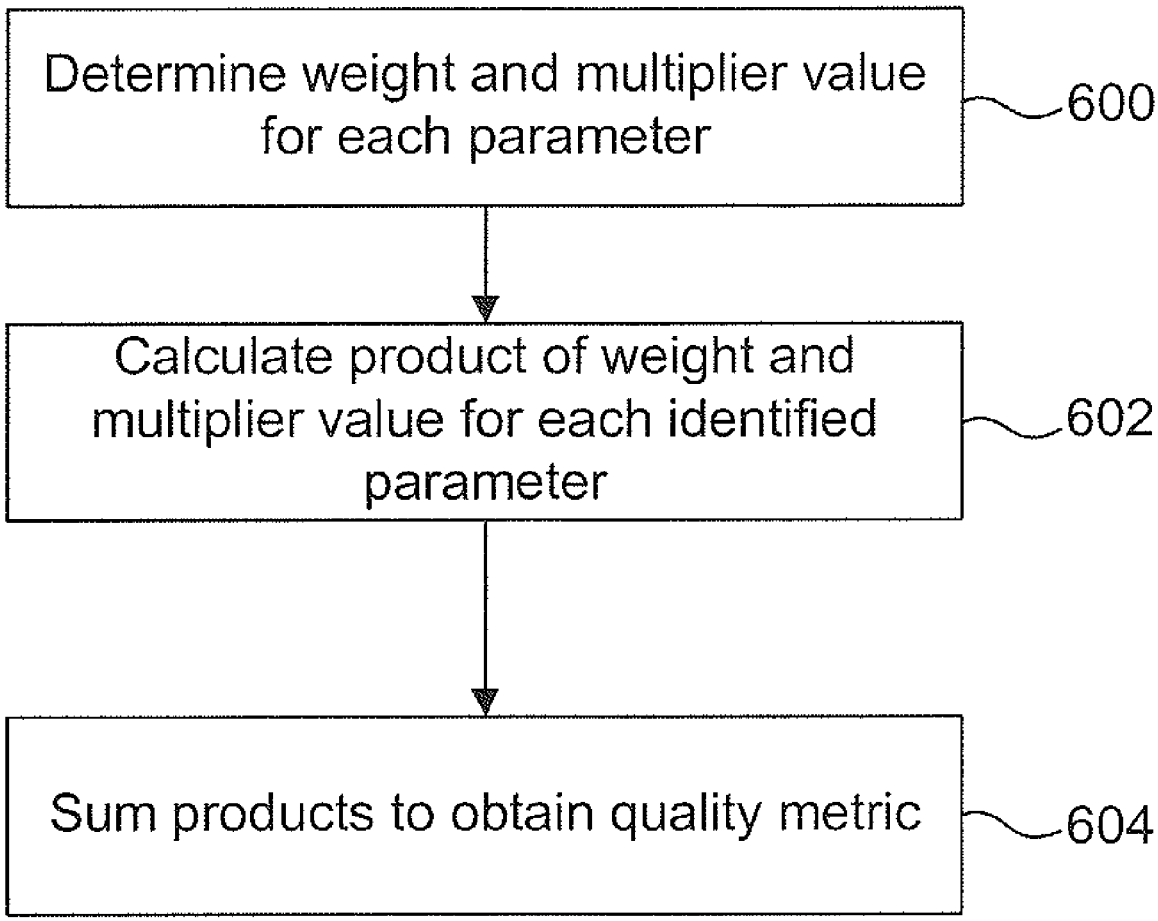
FIG. 6 is a flowchart illustrating an example operation of a portion of the flowchart illustrated in FIGS. 4B and 5B.

FIG. 6 is a flowchart illustrating an example operation of a portion of the flowchart illustrated in FIGS. 4B and 5B. The steps of the flowchart in FIG. 6 may be performed by SST 400 or the SETCAT system 500 described above.

In step 600, a weight and multiplier for each identified parameter are determined. In one embodiment the weight and multiplier are determined by a user.

In step 602, a product of the weight and the multiplier determined for each parameter is calculated. In one embodiment the product may be calculated by SST 400 and in another embodiment the product may be calculated by computational unit 508.

In step 604, the products of weights and multipliers determined in step 602 are summed to obtain a quality metric. In one embodiment, the products may be summed by SST 400 and in another embodiment the product may be calculated by computational unit 508.

The quality metric or AQM may be defined as:

$$\text{Complexity metric(AQM)}=\Sigma(\text{weight}_j\times\text{multiplier}_j) \quad (1)$$

The quality metric may also be defined as:

$$\text{Airspace Quality Metric(AQM)}=f(\text{weight}_j,\text{multiplier}_j) \quad (2)$$

where $f$ is a function.

In general, the quality metric may be defined as:

$$\text{Airspace Quality Metric(AQM)}=f(\text{quantified factors}) \quad (3)$$

where $f$ is a function.

It is to be appreciated that example ways of calculating the quality metric of an airspace design or airspace sector design from quantified factors are provided for purposes of illustration, and are not intended to be limiting. Further ways of estimating the quality metric of an airspace design are also within the scope of the present invention. Such further ways of estimating the quality metric of an airspace design may become apparent to persons skilled in the relevant art(s) from the teachings herein. It is also to be appreciated that the quality metric may be calculated for each sector of an airspace design or the entire airspace design over multiple sectors. The quality metric may be calculated for the entire airspace design as a function of the quality metrics for each individual airspace sector design.

The present invention, or portions thereof, can be implemented in hardware, firmware, software, and/or combinations thereof.

Figure 7:
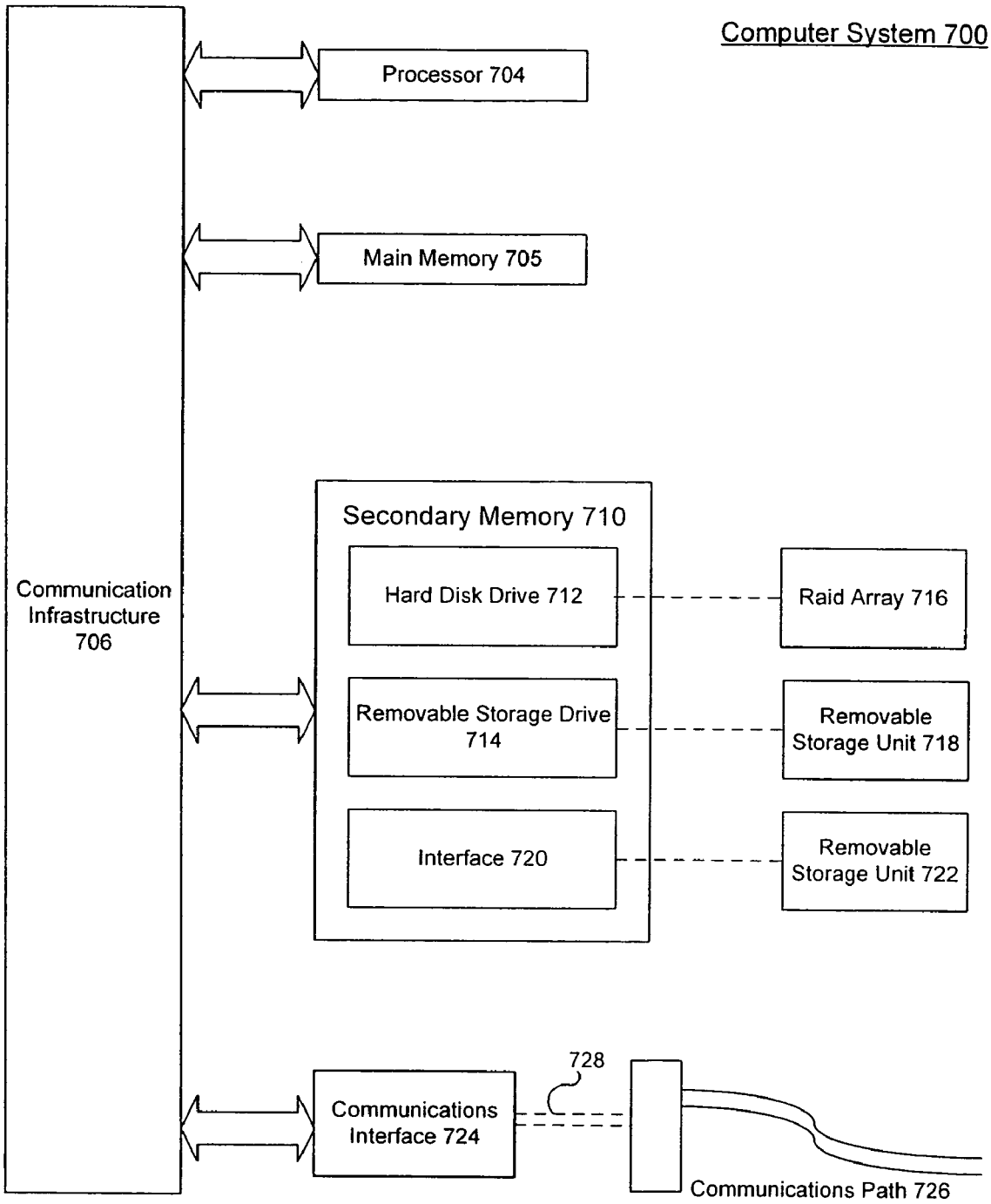
FIG. 7 is a block diagram of a computer system on which the present invention can be implemented.

The following description of a general purpose computer system is provided for completeness. The present invention can be implemented in hardware, or as a combination of software and hardware. Consequently, the invention may be implemented in the environment of a computer system or other processing system. An example of such a computer system 700 is shown in FIG. 7. The computer system 700 includes one or more processors, such as processor 704. Processor 704 can be a special purpose or a general purpose digital signal processor. The processor 704 is connected to a communication infrastructure 706 (for example, a bus or network). Various software implementations are described in terms of this exemplary computer system. After reading this description, it will become apparent to a person skilled in the relevant art how to implement the invention using other computer systems and/or computer architectures.

Computer system 700 also includes a main memory 705, preferably random access memory (RAM), and may also include a secondary memory 710. The secondary memory 710 may include, for example, a hard disk drive 712, and/or a RAID array 716, and/or a removable storage drive 714, representing a floppy disk drive, a magnetic tape drive, an optical disk drive, etc. The removable storage drive 714 reads from and/or writes to a removable storage unit 718 in a well known manner. Removable storage unit 718, represents a floppy disk, magnetic tape, optical disk, etc. As will be appreciated, the removable storage unit 718 includes a computer usable storage medium having stored therein computer software and/or data.

In alternative implementations, secondary memory 710 may include other similar means for allowing computer programs or other instructions to be loaded into computer system 700. Such means may include, for example, a removable storage unit 722 and an interface 720. Examples of such means may include a program cartridge and cartridge interface (such as that found in video game devices), a removable memory chip (such as an EPROM, or PROM) and associated socket, and other removable storage units 722 and interfaces 720 which allow software and data to be transferred from the removable storage unit 722 to computer system 700.

Computer system 700 may also include a communications interface 724. Communications interface 724 allows software and data to be transferred between computer system 700 and external devices. Examples of communications interface 724 may include a modem, a network interface (such as an Ethernet card), a communications port, a PCMCIA slot and card, etc. Software and data transferred via communications interface 724 are in the form of signals 728 which may be electronic, electromagnetic, optical or other signals capable of being received by communications interface 724. These signals 728 are provided to communications interface 724 via a communications path 726. Communications path 726 carries signals 728 and may be implemented using wire or cable, fiber optics, a phone line, a cellular phone link, an RF link and other communications channels.

The terms "computer program medium" and "computer usable medium" are used herein to generally refer to media such as removable storage drive 714, a hard disk installed in hard disk drive 712, and signals 728. These computer program products are means for providing software to computer system 700.

Computer programs (also called computer control logic) are stored in main memory 708 and/or secondary memory 710. Computer programs may also be received via communications interface 724. Such computer programs, when executed, enable the computer system 700 to implement the present invention as discussed herein. In particular, the computer programs, when executed, enable the processor 704 to implement the processes of the present invention. Where the invention is implemented using software, the software may be stored in a computer program product and loaded into computer system 700 using raid array 716, removable storage drive 714, hard drive 712 or communications interface 724.

In other embodiments, features of the invention are implemented primarily in hardware using, for example, hardware components such as Application Specific Integrated Circuits (ASICs) and gate arrays. Implementation of a hardware state machine so as to perform the functions described herein will also be apparent to persons skilled in the relevant art(s).

Embodiments of the invention may be implemented in hardware, firmware, software, or any combination thereof. Embodiments of the invention may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact result from computing devices, processors, controllers, or other devices executing the firmware, software, routines, instructions, etc.

CONCLUSION

While various embodiments of the present invention have been described above, it should be understood that they have been presented by way of example, and not limitation. It will be apparent to persons skilled in the relevant art that various changes in form and detail can be made therein without departing from the spirit and scope of the invention.

The present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. A computer-based method to evaluate quality of an airspace sector design, comprising:

(a) identifying factors contributing to quality of said airspace sector design, wherein the factors measure at least flow placement, interaction between flows and interaction between flows and sector geometry and wherein said factors are stored in a memory;

(b) quantifying said factors stored in said memory; and (c) calculating a quality metric for said airspace sector design, using a computational device, as a function of said quantified factors;

wherein the factors determine a distance of a traffic flow from adjacent boundaries of a sector or distance of a traffic flow from a boundary runner, and wherein a boundary runner is an air traffic flow that is located proximate to a sector boundary.

2. The method of claim 1, further comprising identifying categories for each of said factors.

3. The method of claim 2, further comprising identifying parameters for each of said categories wherein a parameter has an associated weight and a range of associated thresholds, each threshold associated with a multiplier.

4. The method of claim 3, further comprising identifying a threshold from said range of associated thresholds and a multiplier associated with the identified threshold for each identified parameter.

5. The method of claim 4, further comprising calculating a product of said associated weight and said identified multiplier for each identified parameter.

6. The method of claim 5, further comprising calculating a sum of products for each identified parameter to obtain said quality metric.

7. The method of claim 1, wherein said factors comprise airspace types, airspace shelves, special use airspaces, sector-provided approach services, separation standards, flow factors and fleet mix commonalities.

8. The method of claim 1, wherein the factors are based on aircraft flows.

9. The method of claim 1, wherein the identifying further comprises:

receiving user input to identify flow factors.

10. The method of claim 1, wherein the identifying further comprises:

receiving user input to identify flow factors that include at least one of merge points, branch points, random flights, point outs, single or bi-directional flows, arrivals and departures and boundary runners.

11. The method of claim 1, wherein said factors comprise flow factors and airspace shelves and one or more of airspace types, special use airspaces, sector-provided approach services, separation standards, and fleet mix commonalities.

12. The method of claim 1, wherein the factors include fleet mix commonality.

13. The method of claim 1, wherein the factors include fleet mix commonality and flow factors.

14. The method of claim 1, wherein the factors include fleet mix commonality, flow factors, airspace type and separation standards.

15. The method of claim 1, wherein the factors measure distances between adjacent flows, fleet mix commonality, number of flows merging, number of flows crossing, and traffic flow rate.

16. The method of claim 1, wherein the factors measure a number of flows which are located within a specific distance from a sector boundary.

17. The method of claim 1, wherein the factors measure at least a number of merges, number of flows at a merge, distance from a boundary, distance from a boundary upon entry, distance from a boundary upon exit, distance between merge points and convergence angle of each flow.

18. A computer program product comprising a non-transitory computer readable medium including control logic stored therein that, when executed by a processing device, causes the processing device to perform operations to design and evaluate an airspace sector design, the operations comprising:

receiving user input to create an airspace sector design;

receiving user input identifying factors contributing to quality of said airspace sector design;

quantifying said factors; and calculating a quality metric for said airspace sector design based on said quantified factors, wherein the factors measure at least flow placement, interaction between flows and interaction between flows, and sector geometry, wherein the factors determine a distance of a traffic flow from adjacent boundaries of a sector or distance of a traffic flow from a boundary runner, and wherein a boundary runner is an air traffic flow that is located proximate to a sector boundary.

19. The computer program product of claim 18, the operations further comprising generating a Graphical User Interface.

20. The computer program product of claim 18, the operations further comprising modifying said airspace sector design in response to user input.

21. The computer program product of claim 18, the operations further comprising displaying two dimensional and three dimensional views of said airspace sector design in response to user input.

22. The computer program product of claim 18, the operations further comprising comparing said airspace sector design and said quality metric to design metrics.

23. A system to evaluate an airspace sector design, comprising:

a design characteristics database of quantified factors contributing to quality of an airspace sector design; and a computational unit coupled to said design characteristics database;

wherein said computational unit is enabled to receive user input identifying factors contributing to quality of said airspace sector design and calculate a quality metric for said airspace sector design based on said identified factors, wherein the factors measure at least flow placement, interaction between flows and interaction between flows and sector geometry, wherein the factors determine a distance of a traffic flow from adjacent boundaries of a sector or distance of a traffic flow from a boundary runner, and wherein a boundary runner is an air traffic flow that is located proximate to a sector boundary.

24. The system of claim 23, wherein said computational unit is coupled to a drawing database and a geographical database and is enabled to receive user input to generate an airspace sector design using said drawing database and said geographical database.

25. The system of claim 23, wherein each factor comprises at least one category.

26. The system of claim 25, wherein each category comprises at least one parameter, each parameter including an associated weight and a range of associated thresholds, each threshold associated with a multiplier.

27. The system of claim 26, wherein said computational unit is enabled to receive user input identifying a category and a parameter for each identified factor.

28. The system of claim 27, wherein said computational unit is enabled to identify a threshold from said range of associated thresholds and a multiplier associated with the identified threshold for each identified parameter.

29. The system of claim 28, wherein said computational unit is enabled to calculate a product of said associated weight and said identified multiplier for each identified parameter.

30. The system of claim 29, wherein said computational unit is enabled to calculate a sum of products to obtain said quality metric.

31. A computer program product comprising a non-transitory computer useable medium including control logic stored therein that, when executed by a processing device, causes the processing device to perform operations to design and evaluate an airspace sector design, the operations comprising:

receiving user input to create an airspace sector design;

receiving user input identifying factors contributing to quality of said airspace sector design;

quantifying said factors; and calculating a quality metric for said airspace sector design based on said quantified factors, wherein the factors measure at least flow placement, interaction between flows, interaction between flows and sector geometry, a number of merges, number of flows at a merge, distance from a boundary, distance from a boundary upon entry, distance from a boundary upon exit, distance between merge points and a convergence angle of each flow.

32. The computer program product of claim 31, the operations further comprising modifying said airspace sector design in response to user input.

33. The computer program product of claim 31, the operations further comprising displaying two dimensional and three dimensional views of said airspace sector design in response to user input.

34. The computer program product of claim 31, the operations further comprising comparing said airspace sector design and said quality metric to design metrics.

35. The computer program product of claim 31, wherein the factors measure distances between adjacent flows, fleet mix commonality, number of flows merging, number of flows crossing, and traffic flow rate.

* * * * *

UNITED STATES PATENT AND TRADEMARK OFFICE

CERTIFICATE OF CORRECTION

PATENT NO. : 8,190,353 B2
APPLICATION NO. : 11/510781
DATED : May 29, 2012
INVENTOR(S) : White et al.

It is certified that error appears in the above-identified patent and that said Letters Patent is hereby corrected as shown below:

Column 17, line 28, replace “geometry and” with --geometry, and--.

Column 17, line 32, replace “using” with --by--.

Signed and Sealed this
Twenty-eighth Day of August, 2012

David J. Kappos

David J. Kappos
*Director of the United States Patent and Trademark Office*